US005981456A

United States Patent [19]

Tartakovsky et al.

[11] Patent Number: 5,981,456

[45] Date of Patent: Nov. 9, 1999

[54] AUTOMATIC DISHWASHING COMPOSITIONS CONTAINING WATER SOLUBLE CATIONIC OR AMPHOTERIC POLYMERS

[75] Inventors: Alla Tartakovsky, West Orange; Joseph Oreste Carnali, Pompton Plains; Richard Gerald Gary, West New York, all of N.J.

[73] Assignee: Lever Brothers Company, New York, N.Y.

[21] Appl. No.: 08/898,758

[22] Filed: Jul. 23, 1997

[51] Int. Cl.[6] ..... C11D 3/37; C11D 3/06; C11D 3/10

[52] U.S. Cl. ..... 510/220; 510/223; 510/230; 510/232; 510/233; 510/302; 510/401; 510/434; 510/436; 510/467; 510/475; 510/480; 510/485; 510/509; 510/510; 510/511; 510/512; 510/514

[58] Field of Search ..... 510/220, 223, 510/230, 232, 233, 302, 401, 434, 436, 467, 475, 480, 485, 509, 510, 511, 512, 514

[56] References Cited

U.S. PATENT DOCUMENTS

| | | | |
|---|---|---|---|
| 4,465,802 | 8/1984 | Dennen et al. | 524/395 |
| 4,773,939 | 9/1988 | Meffert et al. | 134/10 |
| 4,874,538 | 10/1989 | Dawson et al. | 252/117 |
| 5,208,369 | 5/1993 | Crump et al. | 562/106 |
| 5,352,386 | 10/1994 | Rahman et al. | 252/548 |
| 5,733,858 | 3/1998 | Wilson et al. | 510/361 |

FOREIGN PATENT DOCUMENTS

| | | |
|---|---|---|
| 0260017 | 3/1988 | European Pat. Off. . |
| 0372782 | 6/1990 | European Pat. Off. . |

*Primary Examiner*—Yogendra Gupta
*Assistant Examiner*—Charles Boyer
*Attorney, Agent, or Firm*—Neil Y. Gilbert, Esq.

[57] ABSTRACT

An automatic dishwashing detergent composition is described which contains an effective amount of a defined water soluble cationic or amphoteric polymer and a phosphate or nonphosphate builder. The polymers are soluble or dispersible to at least 0.01% by weight in distilled water at 25° C. A method of using the polymers to prevent fading or corrosion of dishware is also described.

12 Claims, No Drawings

AUTOMATIC DISHWASHING COMPOSITIONS CONTAINING WATER SOLUBLE CATIONIC OR AMPHOTERIC POLYMERS

FIELD OF THE INVENTION

The present invention is in the field of machine dishwashing. More specifically, the invention encompasses automatic dishwashing detergents in granular, liquid, gel, solid and tablet form which contain a cationic or amphoteric water soluble polymer for the purpose of reducing the corrosion of decorated glassware.

BACKGROUND OF THE INVENTION

Machine dishwashing detergents constitute a generally recognized distinct class of detergent compositions. In general, machine dishwashing detergents are mixtures of ingredients whose purpose, in combination, is to breakdown and remove food soils; to inhibit foaming caused by certain food soils; to promote the wetting of wash articles in order to minimize or eliminate visually observable spotting and filming; to remove stains such as might be caused by beverages such as coffee and tea or by vegetable soils such as carotenoid soils; to prevent a buildup of soil films on wash ware surfaces; and to reduce or eliminate tarnishing of flatware. An additional and critical characteristic which the machine dishwashing detergent must possess is the ability to perform all of the above tasks without substantially etching or corroding or otherwise damaging the surface of glasses or dishes. It is particularly critical that the fading and loss of luster from brightly colored decorations on glasses and dishes be prevented.

In conventional institutional and domestic dishwashing formulations, a strongly alkaline solution is produced and is used to wash dishes, glasses, and other cooking and eating utensils. Ordinary tap water can be used in preparing these strongly alkaline cleaning solutions and for rinsing the wash articles subsequent to the cleaning step. However, in European applications, this tap water is often treated (softened) to remove hardness ions such as calcium and magnesium with the result that hard water residues on washware are reduced. Nevertheless, spotting and filming from soil residues and precipitates can remain a problem, especially if the ion exchange unit serving the dishwashing machine is operating inefficiently. This problem can be minimized with a machine dishwashing composition containing a relatively high level of polyphosphate which acts to sequester hardness ions and to aid in soil removal and stabilization. In addition, these detergents usually contain a chlorine bleaching system for stain removal and for an added cleaning boost via oxidation of proteinaceous soils, thus helping to eliminate spotting on glassware.

Although the cleaning performance of these conventional detergent compositions is satisfactory, high phosphate levels, chlorine bleach, and high alkalinity have potential environmental and consumer drawbacks. As a result, an alternative technology was developed to deliver less alkaline products. Similarly, nonphosphated builders are substituted to further improve the environmental profile of the composition. As a consequence of the reduced cleaning efficiency of the modified composition, various detersive enzymes including amylolytic and proteolytic enzymes are included in the detergent composition in order to boost removal of starchy and proteinaceous soils, respectively. Because these enzymes are not compatible with chlorine bleach systems, an oxygen bleaching system can be substituted which can result in a reduction in bleach performance. Often, enzymatic compositions based on oxygen bleaches are formulated with a phosphate builder, in markets where local legislation will allow, to assure good overall performance. An unfortunate weakness in the performance of this alternative technology, both in formulations which are phosphated (i.e., containing inorganic phosphate builder salts) and those which are nonphosphated, is that they are particularly prone to attacking patterned glasses and plates. The striking color of this patterning is often a key reason for the purchase of the article and its rapid fading after a relatively few dishwashing cycles can be particularly noticeable and give rise to an unfavorable rating by the consumer of an otherwise premium performing machine dishwashing product.

It is an object of the present invention to provide compositions, suitable for use in machine dishwashing methods, having a reduced tendency to fade or otherwise corrode brightly patterned plates and glasses while at the same time maintaining good cleaning performance towards soiled articles.

UK Patent Application GB 2 295 625 A and WO 96/17051 disclose compositions for use in machine dishwashing comprising a mixture of disilicate and metasilicate in which the weight ratio of disilicate to metasilicate is from 50:1 to 3:2. The minor proportion of metasilicate is described to reduce glass pattern corrosion.

WO 96/20268 describes a copolymer of an organomineral siliconate, obtained by condensation polymerization of an alkali metal disilicate and an alkali metal siliconate, as an additive in a machine dishwashing formulation for the purpose of reducing weight loss and visible corrosion on glass.

WO 96/20129 discloses an alkali metal silicate partially substituted with calcium, magnesium, strontium or cerium as counterion. This modified silicate, incorporated into a machine dishwashing composition, is described to reduce the weight loss and visible corrosion of washed glassware.

WO 96/12783 describes the inclusion of a crystalline layered silicate of the general formula $Na_2Si_xO_{2+1}.yH_2O$ for preserving the color and luster of patterned glassware during machine dishwashing.

The prior art thus describes the use of specific silicates or modified silicates to avoid dishwashing fading or corrosion. This basis restricts the type of formulation to which these solutions are applicable. In particular, corrosion of patterned glassware can be quite severe with formulations of low alkalinity, where silicates are of limited use because of their low stability.

Recently, the use of transition metal salts, particularly of aluminum, has been described in Angevaare et al., U.S. Ser. No. 08/444,502 for use in mitigating the fading of colors from decorated glassware. The use of aluminum complexes with such as citrate has been described for the same purpose in Angevaare et al., U.S. Ser. No. 08/786,357 and U.S. Pat. No. 5,624,892. Formulations containing silica for reducing glass pattern corrosion are described (Alan Tomlinson, LDC.)

SUMMARY OF THE INVENTION

It has now been discovered that a class of water soluble, cationic or amphoteric polymers provide an unexpected and superior level of protection to decorated glassware when incorporated into a machine dishwashing detergent. Such protection is illustrated by, but not limited to, the prevention of fading and loss in luster of colored decorations and the reduction in weight loss from washed glass articles. The present invention encompass machine dishwashing detergents having a) an effective amount of a defined cationic or amphoteric water soluble polymer; and b) an effective amount of a builder.

"Water soluble" polymers are, unless otherwise noted, here defined to include polymers which, because of their molecular weight or monomer composition, are soluble or dispersible to at least the extent of 0.01% by weight in distilled water at 25° C. "Cationic" polymers herein comprise polymers in which at least one of the monomer units making up the polymer contains a cationic charge over a portion of the wash pH range of pH 6 to pH 11, those monomer units not containing cationic charges being nonionic in nature. "Amphoteric" polymers herein are defined as polymers in which at least one of the comprising monomer units contains a cationic charge over a portion of the pH range 6–11 and at least one of the comprising monomer units contains an anionic charge over the same portion of the pH range 6–11. The overall composition of an amphoteric polymer can otherwise freely be chosen from among monomers containing cationic charge(s), monomers containing anionic charge(s), monomer units containing both cationic and anionic charge(s), and monomer units which are nonionic in nature—so long as the above definition is satisfied.

It is expected that the wash pH at which this invention would be employed would either naturally fall within the above mentioned portion of the pH range 6–11 or, optionally, would be buffered in that range.

DETAILED DESCRIPTION OF THE INVENTION

The present composition contains as essential components a water soluble cationic or amphoteric polymer and a phosphate or nonphosphate builder.

Phosphate builder

The compositions of the present invention which utilize a water-soluble phosphate builder typically contain this builder at a level of from 1 to 90% by weight, preferably from 10 to 80% by weight, most preferably from 20 to 70% by weight of the composition. Specific examples of water-soluble phosphate builders are the alkali metal tripolyphosphates, sodium, potassium and ammonium pyrophosphate, sodium and potassium orthophosphate, sodium polymeta/phosphate in which the degree of polymerization ranges from about 6 to 21, and salts of phytic acid. Sodium or potassium tripolyphosphate is most preferred.

Nonphosphate Builder

The compositions of the present invention which utilize a water-soluble nonphosphate builder typically contain this builder at a level of from 1 to 90% by weight, preferably from 10 to 80% by weight, most preferably from 20 to 70% by weight of the composition. Suitable examples of non-phosphorus-containing inorganic builders include water-soluble alkali metal carbonates, bicarbonates, sesquicarbonates, borates, silicates, including layered silicates such as SKS-6 ex. Hoechst, metasilicates, and crystalline and amorphous aluminosilicates. Specific examples include sodium carbonate (with or without calcite seeds), potassium carbonate, sodium and potassium bicarbonates, silicates including layered silicates and zeolites.

Organic detergent builders can also be used as nonphosphate builders in the present invention. Examples of organic builders include alkali metal citrates, succinates, malonates, fatty acid sulfonates, fatty acid carboxylates, nitrilotriacetates, oxydisuccinates, alkyl and alkenyl disuccinates, oxydiacetates, carboxymethyloxy succinates, ethylenediamine tetraacetates, tartrate monosuccinates, tartrate disuccinates, tartrate monoacetates, tartrate diacetates, oxidized starches, oxidized heteropolymeric polysaccharides, polyhydroxysulfonates, polycarboxylates such as polyacrylates, polymaleates, polyacetates, polyhydroxyacrylates, polyacrylate/polymaleate and polyacrylate/polymethacrylate copolymers, acrylate/maleate/vinyl alcohol terpolymers, aminopolycarboxylates and polyacetal carboxylates, and polyaspartates and mixtures thereof. Such carboxylates are described in U.S. Pat. Nos. 4,144,226, 4,146,495 and 4,686,062. Alkali metal citrates, nitrilotriacetates, oxydisuccinates, acrylate/maleate copolymers and acrylate/maleate/vinyl alcohol terpolymers are especially preferred nonphosphate builders.

Water Soluble Cationic or Amphoteric Polymer

A water soluble cationic or amphoteric polymer is here defined to include polymers which, because of their molecular weight or monomer composition, are soluble or dispersible to at least the extent of 0.01% by weight in distilled water at 25° C. Water soluble cationic or amphoteric polymers include polymers in which one or more of the constituent monomers are selected from the list of copolymerizable cationic monomers. These monomer units contain a positive charge over a portion of the pH range 6–11. A partial listing of such monomers is presented in "Water-Soluble Synthetic Polymers: Properties and Behavior, Volume II", by P. Molyneux, CRC Press, Boca Raton, 1983, ISBN 0-8493-6136-incorporated herein by reference. Additional monomers can be found in the "International Cosmetic Ingredient Dictionary, 5th Edition", edited by J. A. Wenninger and G. N. McEwen, The Cosmetic, Toiletry, and Fragrance Association, Washington D.C., 1993, ISBN 1-882621-06-9, incorporated herein by reference. A third source of such monomers can be found in "Encyclopedia of Polymers and Thickeners for Cosmetics", by R. Y. Lochhead and W. R. Fron, Cosmetics & Toiletries, vol. 108, May 1993, pp 95–135, herein incorporated.

Specifically, monomers useful in this invention may be represented structurally as ethenically unsaturated compounds as in formula 1.

I

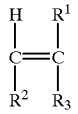

wherein $R^1$ is hydrogen, hydroxyl, or a $C_1$ to $C_{30}$ straight or branched alkyl radical; $R^2$ is hydrogen, or a $C_{1-30}$ straight or branched alkyl, a $C_{1-30}$ straight or branched alkyl substituted aryl, aryl substituted $C_{1-30}$ straight or branched alkyl radical, or a poly oxyalkene condensate of an aliphatic radical; and $R^3$ is a heteroatomic alkyl or aromatic radical containing either one or more quaternerized nitrogen atoms or one or more amine groups which possess a positive charge over a portion of the pH interval pH 6 to 11. Such amine groups can be further delineated as having a $pK_a$ of about 6 or greater, as defined by R. Laughlin in "Cationic Surfactants, Physical Chemistry", edited by D. N. Rubingh and P. M. Holland, Marcel Dekker, New York, 1991, ISBN 0-8247-8357-3.

Examples of cationic monomers of formula I include, but are not limited to, co-poly 2-vinyl pyridine and its co-poly 2-vinyl N-alkyl quaternary pyridinium salt derivatives; co-poly 4-vinyl pyridine and its co-poly 4-vinyl N-alkyl quaternary pyridinium salt derivatives; co-poly 4-vinylbenzyltrialkylammonium salts such as co-poly 4-vinylbenzyltrimethylammonium salt; co-poly 2-vinyl piperidine and co-poly 2-vinyl piperidinium salt; co-poly 4-vinyl piperidine and co-poly 4-vinyl piperidinium salt; co-poly 3-alkyl 1-vinyl imidazolium salts such as co-poly 3-methyl 1-vinyl imidazolium salt; acrylamido and methacrylamido derivatives such as co-poly dimethyl aminopropylmethacrylamide, co-poly acrylamidopropyl trimethylammonium salt and co-poly methacrylamidopropyl trimethylammonium salt; acrylate and methacrylate derivatives such as co-poly dimethyl aminoethyl (meth)acrylate, co-poly ethanaminium N,N,N trimethyl 2-[(1-oxo-2 propenyl)oxy]-salt, co-poly ethanaminium N,N,N trimethyl 2-[(2 methyl-1-oxo-2 propenyl) oxy]-salt, and co-poly ethanaminium N,N,N ethyl dimethyl 2-[(2 methyl-1-oxo-2 propenyl) oxy]-salt.

Also included among the cationic monomers suitable for this invention are co-poly vinyl amine and co-polyvinylammonium salt; co-poly diallylamine, co-poly methyldiallylamine, and co-poly diallydimethylammonium salt; and the ionene class of internal cationic monomers as defined by D. R. Berger in "Cationic Surfactants, Organic Chemistry", edited by J. M. Richmond, Marcel Dekker, New York, 1990, ISBN 0-8247-8381-6, herein incorporated by reference. This class includes co-poly ethylene imine, co-poly ethoxylated ethylene imine and co-poly quaternized ethoxylated ethylene imine; co-poly [(dimethylimino) trimethylene (dimethylimino) hexamethylene disalt], co-poly [(diethylimino) trimethylene (dimethylimino) trimethylene disalt]; co-poly [(dimethylimino) 2-hydroxypropyl salt]; co-polyquarternium-2, co-polyquarternium-17, and co-polyquarternium 18, as defined in the "International Cosmetic Ingredient Dictionary, 5th Edition", edited by J. A. Wenninger and G. N. McEwen.

Additionally, useful polymers are the cationic co-poly amido-amine having the chemical structure of formula II.

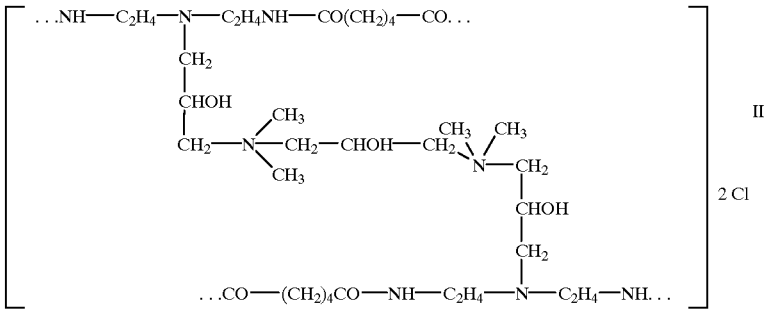

II and the quaternized polyimidazoline having the chemical structure of formula III

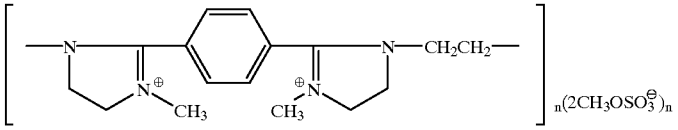

III

An additional class of cationic monomers suitable for this invention are those arising from natural sources and include, but are not limited to, cocodimethylammonium hydroxypropyl oxyethyl cellulose, lauryidimethylammonium hydroxypropyl oxyethyl cellulose, stearyldimethylammonium hydroxypropyl oxyethyl cellulose, and stearyldimethylammonium hydroxyethyl cellulose; guar 2-hydroxy-3-(trimethylammonium)propyl ether salt; cellulose 2-hydroxyethyl 2-hydroxy 3-(trimethyl ammonio) propyl ether salt.

It is likewise envisioned that monomers containing cationic sulfonium salts such as co-poly 1-[3-methyl-4-(vinylbenzyloxy)phenyl] tetrahydrothiophenium chloride would also be applicable to the present invention.

The counterion of the comprising cationic co-monomer is freely chosen from the halides: chloride, bromide, and iodide; or from hydroxide, phosphate, sulfate, hydrosulfate, ethyl sulfate, methyl sulfate, formate, and acetate.

Water soluble amphoteric polymers suitable for incorporation into the present invention can also include polymers in which one or more of the constituent monomers are selected from the list of copolymerizable, internally amphoteric monomers. These monomer units contain both one or more positive charges and one or more negative charges over a portion of the pH range 6–11. Such internally amphoteric monomers include those species possessing formal anionic and cationic charges such as N,N-dimethyl, N-acetyl aminoethyl(meth)acrylate. Also included are monomers which, while not possessing formal charges, have one or more resonance forms which result in the occurrence of fractional cationic and anionic charges being separated within the monomer. Monomers in this class are typified by vinyl pyrrolidone, as described in "Water-Soluble Synthetic Polymers: Properties and Behavior, Volume I", by P. Molyneux, CRC Press, Boca Ratan, 1983, ISBN 0-8493-6135-4, incorporated herein by reference. Further examples include vinyl oxazolidone; vinyl methyoxazolidone; and vinyl caprolactam.

The weight fraction of the cationic or amphoteric polymer which is composed of the above-described cationic or amphoteric monomer units can range from 1 to 100%, preferably from 10 to 100%, and most preferably from 15 to 80% of the entire polymer. The remaining monomer units comprising the cationic or amphoteric polymer are chosen from the class of anionic monomers and the class of nonionic monomers or solely from the class of nonionic monomers. In the former case, the polymer is an amphoteric polymer while in the latter case it can be a cationic polymer, provided that no amphoteric co-monomers are present. The anionic monomers comprise a class of monounsaturated compounds which possess a negative charge over the portion of the pH range from pH 6 to 11 in which the cationic monomers possess a positive charge. The nonionic monomers comprise a class of monounsaturated compounds which are uncharged over the pH range from pH 6 to 11 in which the cationic monomers possess a positive charge. It is expected that the wash pH at which this invention would be employed would either naturally fall within the above mentioned portion of the pH range 6–11 or, optionally, would be buffered in that range. A preferred class of both the anionic and the nonionic monomers are the vinyl (ethylenically unsaturated) substituted compounds corresponding to formula IV.

IV

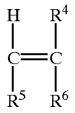

wherein $R^4$, $R^5$, and $R^6$ are independently hydrogen, a $C_1$ to $C_3$ alkyl, a carboxylate group or a carboxylate group substituted with a $C_1$ to $C_{30}$ linear or branched heteroatomic alkyl or aromatic radical, a heteroatomic radical or a poly oxyalkene condensate of an aliphatic radical. The class of anionic monomers are represented by the compound described by formula IV in which at least one of the $R^4$, $R^5$, or $R^6$ comprises a carboxylate, substituted carboxylate, phosphonate, substituted phosphonate, sulfate, substituted sulfate, sulfonate, or substituted sulfonate group. Preferred monomers in this class include but are not limited to α-ethacrylic acid, α-cyano acrylic acid, β,β-dimethacrylic acid, methylenemalonic acid, vinylacetic acid, allylacetic acid, acrylic acid, ethylidineacetic acid, propylidineacetic acid, crotonic acid, methacrylic acid, maleic acid, fumaric acid, itaconic acid, sorbic acid, angelic acid, cinnamic acid, β-styryl acrylic acid (1-carboxy-4-phenyl butadiene-1,3), citraconic acid, glutaconic acid, aconitic acid, α-phenylacrylic acid, β-acryloxy propionic acid, citraconic acid, vinyl benzoic acid, N-vinyl succinamidic acid, and mesaconic acid. Also included in the list of preferred monomers are co-poly styrene sulfonic acid, 2-methacryloyloxymethane-1-sulfonic acid, 3-methacryloyloxypropane-1-sulfonic acid, 3-(vinyloxy) propane-1-sulfonic acid, ethylenesulfonic acid, vinyl sulfuric acid, 4-vinylphenyl sulfuric acid, ethylene phosphonic acid and vinyl phosphoric acid. Most preferred monomers include acrylic acid, methacrylic acid and maleic acid. The polymers useful in this invention may contain the above monomers and the alkali metal, alkaline earth metal, and ammonium salts thereof.

The class of nonionic monomers are represented by the compounds of formula IV in which none of the $R^4$, $R^5$, or $R^6$ contain the above mentioned negative charge containing radicals. Preferred monomers in this class include, but are not limited to, vinyl alcohol; vinyl acetate; vinyl methyl ether; vinyl ethyl ether; acrylamide, methacrylamide and other modified acrylamides; vinyl propionate; alkyl acrylates (esters of acrylic or methacrylic acid); and hydroxyalkyl acrylate esters. A second class of nonionic monomers include co-poly ethylene oxide, co-poly propylene oxide, and co-poly oxymethylene. A third class of nonionic monomers includes naturally derived materials such as hydroxyethylcellulose.

The average molecular weight of the polymers of this invention range from about 1000 to about $10^7$, with the preferred molecular weight range depending on the polymer composition. An effective amount of said polymer is 0.1 to 20%, preferably 0.5 to 10%, most preferably 1 to 5%, all by weight, of the total detergent formulation.

Optional Ingredients

In addition to the essential ingredients described herein above, the compositions of the invention may be formulated as detergent compositions comprising conventional ingredients, preferably selected from enzymes, buffering systems, oxygen bleaching systems, surfactants, heavy metal ion sequestrants, antiscalants, corrosion inhibitors, and antifoams.

Enzymes

Enzymes capable of facilitating the removal of soils from a substrate may also be present in a combined amount of up to about 10% by weight of active enzyme. Such enzymes include proteases, amylases, lipases, esterases, cellulases, pectinases, lactases and peroxidases as conventionally incorporated into detergent compositions.

Preferred commercially available protease enzymes include those sold under the tradenames Alcalase, Savinase and Esperase from Novo Industries A/S (Denmark); and those sold by Genencor International under the tradename Purafect OxP. Preferred commercially available amylases include those α-amylases sold under the tradenames Termamyl and Duramyl from Novo Industries and those sold by Genencor International under the tradename Purafect OxAm. A preferred lipase is commercially available from Novo Industries under the trade name Lipolase.

Buffering System

The buffering system may be present in order to deliver a pH of about 6 to about 11 in the wash water. Materials which may be selected for the buffering system include water-soluble alkali metal carbonates, bicarbonates, sesquicarbonates, borates, silicates, layered silicates such as SKS-6 ex Hoechst, metasilicates, phytic acid, citric acid, borate and crystalline and amorphous aluminosilicates and mixtures thereof. Preferred examples include sodium and potassium carbonate, sodium and potassium bicarbonates, borates and silicates, including layered silicates.

Oxygen Bleaching Systems

The present invention may optionally contain an oxygen bleach source chosen from the following:

Peroxy Bleaching Agents—The oxygen bleaching agents of the compositions include organic peroxy acids and diacylperoxides. Typical monoperoxy acids useful herein include alkyl peroxy acids and aryl peroxy acids such as:

i) peroxybenzoic acid and ring-substituted peroxybenzoic acids, e.g., peroxy-alpha-naphthoic acid, and magnesium monoperoxyphthalate ii) aliphatic and substituted aliphatic monoperoxy acids, e.g., peroxylauric acid, peroxystearic acid, epsilon-phthalimido-peroxyhexanoic acid and o-carboxybenzamido peroxyhexanoic acid, N-nonylamidoperadipic acid and N-nonylamidopersuccinic acid.

iii) Cationic peroxyacids such as those described in U.S. Pat. No. 5,422,028, 5,294,362; and 5,292,447, Oakes et al., U.S. Ser. No. 08/738,504; and U.S. Ser. No. 08/210,973, Oakes et al., herein incorporated by reference.

iv) Sulfonyl peroxyacids such as compounds described in U.S. Pat. No. 5,039,447 (Monsanto Co.), herein incorporated by reference.

Typical diperoxy acids useful herein include alkyl diperoxy acids and aryl diperoxy acids, such as:

v) 1,12-diperoxydodecanedioic acid vi) 1,9-diperoxyazelaic acid vii) diperoxybrassylic acid; diperoxysecacic acid and diperoxy-isophthalic acid viii) 2-decyldiperoxybutan-1,4-dioic acid ix) $N,N^1$-terephthaloyl-di(6-aminopercaproic acid).

A typical diacylperoxide useful herein includes dibenzoylperoxide.

Inorganic peroxygen compounds are also suitable for the present invention. Examples of these materials useful in the invention are salts of monopersulfate, perborate monohydrate, perborate tetrahydrate, and percarbonate.

Preferred peroxy bleaching agents include epsilon-phthalimido-peroxyhexanoic acid, o-carboxybenzamidoperoxyhexanoic acid, and mixtures thereof.

The organic peroxy acid is present in the composition in an amount such that the level of organic peroxy acid in the wash solution is about 1 ppm to about 300 ppm AvOx, preferably about 2 ppm to about 200 ppm AvOx.

The oxygen bleaching agent may be incorporated directly into the formulation or may be encapsulated by any number of encapsulation techniques.

A preferred encapsulation method is described in U.S. Pat. No. 5,200,236 issued to Lang et al., herein incorporated by reference. In the patented method, the bleaching agent is encapsulated as a core in a paraffin wax material having a melting point from about 40° C. to 50° C. The wax coating has a thickness of from 100 to 1500 microns.

Bleach Precursors—Suitable peracid precursors for peroxy bleach compounds have been amply described in the literature, including GB Nos. 836,988; 855,735; 907,356; 907;358; 907,950; 1,003,310 and 1,246,339; U.S. Pat. Nos. 3,332,882 and 4,128,494.

Typical examples of precursors are polyacylated alkylene diamines, such as N,N,N',N'-tetraacetylethylene diamine (TAED) and N,N,N',N'-tetraacetylmethylene diamine (TAMD); acylated glycolurils, such as tetraacetylglycoluril (TAGU); triacetylcyanurate, sodium sulfophenyl ethyl carbonic acid ester, sodium acetyloxybenene sulfonate (SABS), sodium nonanoyloxy benzene sulfonate (SNOBS) and choline sulfophenyl carbonate. Peroxybenzoic acid precursors are known in the art, e.g., as described in GB-A-836,988. Examples of suitable precursors are phenylbenzoate; phenyl p-nitrobenzoate; o-nitrophenyl benzoate; o-carboxyphenyl benzoate; p-bromophenylbenzoate; sodium or potassium benzoyloxy benzene-sulfonate; and benzoic anhydride.

Preferred peroxygen bleach precursors are sodium p-benzoyloxybenzene sulfonate, N,N,N',N'-tetraacetylethylene diamine, sodium nonanoyloxybenzene sulfonate and choline sulfophenyl carbonate.

The peroxygen bleach precursors are present in the composition in an amount from about 1 to about 20 weight percent, preferably from about 1 to about 15 wt. %, most preferably from about 2 to about 15 wt. %. To deliver a functional peroxygen bleach from a precursor, a source of hydrogen peroxide is required. The hydrogen peroxide source is preferably a compound that delivers hydrogen peroxide on dissolution. Preferred sources of hydrogen peroxide are sodium perborate, either as the mono- or tetrahydrate and sodium percarbonate. The source of hydrogen peroxide, when included in these compositions is present at a level of about 1% to about 40% by weight, preferably from about 2% to about 30% by weight, most preferably from about 4% to about 25% by weight.

Bleach Catalyst—An effective amount of a bleach catalyst can also be present in the invention. A number of organic catalysts are available such as the sulfonimines as described in U.S. Pat. Nos. 5,041,232; 5,047,163 and 5,463,115.

Transition metal bleach catalysts are also useful, especially those based on manganese, iron, cobalt, titanium, molybdenum, nickel, chromium, copper, ruthenium, tungsten and mixtures thereof. These include simple water-soluble salts such as those of iron, manganese and cobalt as well as catalysts containing complex ligands.

Suitable examples of manganese catalysts containing organic ligands are described in U.S. Pat. No. 4,728,455, U.S. Pat. No. 5,114,606, U.S. Pat. No. 5,153,161, U.S. Pat. No. 5,194,416, U.S. Pat. No. 5,227,084, U.S. Pat. No. 5,244,594, U.S. Pat. No. 5,246,612, U.S. Pat. No. 5,246,621, U.S. Pat. No. 5,256,779, U.S. Pat. No. 5,274,147, U.S. Pat. No. 5,280,117 and European Pat. App. Pub. Nos. 544,440, 544,490, 549,271 and 549,272. Preferred examples of these catalysts include $Mn^{IV}{}_2(u\text{-}O)_2$(1,4,7-trimethyl-1,4,7-triazacyclononane)$_2(PF_6)_2$, $Mn^{III}{}_2(u\text{-}O)_1(u\text{-}OAc)_2$(1,4,7-trimethyl-1,4,7-triazacyclononane)$_2(ClO_4)_2$, $Mn^{IV}{}_4(u\text{-}O)_6$(1,4,7-triazacyclononane)$_4(ClO_4)_4$, $Mn^{III}Mn^{IV}{}_4(u\text{-}O)_1(u\text{-}OAc)_2$(1,4,7-trimethyl-1,4,7-triazacyclononane)$_2(ClO_4)_3$, $Mn^{IV}$(1,4,7-trimethyl-1,4,7-triazacyclononane)-$(OCH_3)_3(PF_6)$, and mixtures thereof. Other metal-based bleach catalysts include those disclosed in U.S. Pat. No. 4,430,243 and U.S. Pat. No. 5,114,611.

Iron and manganese salts of aminocarboxylic acids in general are useful herein including iron and manganese aminocarboxylate salts disclosed for bleaching in the photographic color processing arts. A particularly useful transition metal salt is derived from ethylenediaminedisuccinate and any complex of this ligand with iron or manganese.

Another type of bleach catalyst, as disclosed in U.S. Pat. No. 5,114,606, is a water soluble complex of manganese (II), (III), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose and mixtures thereof. Especially preferred is sorbitol.

U.S. Patent No. 5,114,611 teaches a bleach catalyst comprising a complex of transition metals, including manganese, cobalt, iron or copper with a non-(macro)-cyclic ligand. Other examples include Mn gluconate, $Mn(CF_3SO_3)_2$, and binuclear Mn complexed with tetra-N-dentate and bi-N-dentate ligands, including $[bipy_2Mn^{III}(u\text{-}O)_2Mn^{IV}bipy_2](ClO_4)3$.

Other bleach catalysts are described, for example, in European Pat. App. Pub. Nos. 408,131 (cobalt complexes), 384,503 and 306,089 (metallo-porphyrins), U.S. Pat. No. 4,728,455 (manganese/multidenate ligand), U.S. Pat. No. 4,711,748 (absorbed manganese on aluminosilicate), U.S. Pat. No. 4,601,845 (aluminosilicate support with manganese, zinc or magnesium salt), U.S. Pat. No. 4,626,373 (manganese/ligand), U.S. Pat. No. 4,119,557 (ferric complex), U.S. Pat. No. 4,430,243 (Chelants with manganese cations and non-catalytic metal cations), and U.S. Pat. No. 4,728,455 (manganese gluconates).

Useful catalysts based on cobalt are described in Pat. App. Pub. Nos. WO 96/23859, WO 96/23860 and WO 96/23861 and U.S. Pat. No. 5,559,261. WO 96/23860 describe cobalt catalysts of the type $[Co_nL_mX_p]^zY_z$, where L is an organic ligand molecule containing more than one heteroatom selected from N, P, O and S; X is a coordinating species; n is preferably 1 or 2; m is preferably 1 to 5; p is preferably 0 to 4 and Y is a counterion. One example of such a catalyst is N,N'-Bis(salicylidene)ethylenediaminecobalt (II). Other cobalt catalysts described in these applications are based on Co(III) complexes with ammonia and mon-, bi-, tri- and tetradentate ligands such as $[Co(NH_3)_5OAc]^{2+}$ with $Cl^-$, $OAc^-$, $PF_6^-$, $SO_4^{=}$, and $BF_4^-$ anions.

Certain transition-metal containing bleach catalysts can be prepared in the situ by the reaction of a transition-metal salt with a suitable chelating agent, for example, a mixture of manganese sulfate and ethylenediaminedisuccinate. Highly colored transition metal-containing bleach catalysts may be co-processed with zeolites to reduce the color impact.

When present, the bleach catalyst is typically incorporated at a level of about 0.0001 to about 10% by wt., preferably about 0.001 to about 5% by weight.

Surfactants

Optionally, a surfactant selected from the list including anionic, nonionic, cationic, amphoteric, and zwitteronic surfactants and mixtures of these surface active agents may be included in the machine dishwashing formulation. Such surfactants are well known in the detergent arts and are described at length in "Surface Active Agents and Detergents", Vol. 2 by Schwartz, Perry and Birch, Interscience Publishers, Inc., 1959, herein incorporated by reference.

Preferred surfactants are one or a mixture of:

Anionic surfactants—Anionic synthetic detergents can be broadly described as surface active compounds with one or more negatively charged functional groups. An important class of anionic compounds are the water-soluble salts, particularly the alkali metal salts, of organic sulfur reaction products having in their molecular structure an alkyl radical containing from about 6 to 24 carbon atoms and a radical selected from the group consisting of sulfonic and sulfuric acid ester radicals.

Primary Alkyl Sulfates $$R^7OSO_3M$$

where $R^7$ is a primary alkyl group of 8 to 18 carbon atoms and M is a solubilizing cation. The alkyl group $R^7$ may have a mixture of chain lengths. It is preferred that at least two-thirds of the $R^7$ alkyl groups have a chain length of 8 to 14 carbon atoms. This will be the case if $R^7$ is coconut alkyl, for example. The solubilizing cation may be a range of cations which are in general monovalent and confer water solubility. An alkali metal, notably sodium, is especially envisaged. Other possibilities are ammonium and substituted ammonium ions, such as trialkanolammonium or trialkylammonium.

Alkyl Ether Sulfates $$R^7O(CH_2CH_2O)_nSO_3M$$

where $R^7$ is a primary alkyl group of 8 to 18 carbon atoms, n has an average value in the range from 1 to 6 and M is a solubilizing cation. The alkyl group $R^7$ may have a mixture of chain lengths. It is preferred that at least two-thirds of the $R^7$ alkyl groups have a chain length of 8 to 14 carbon atoms. This will be the case if $R^7$ is coconut alkyl, for example. Preferably n has an average value of 2 to 5.

Fatty Acid Ester Sulfonates $$R^8CH(SO_3M)CO_2R^9$$

where $R^8$ is an alkyl group of 6 to 16 atoms, $R^9$ is an alkyl group of 1 to 4 carbon atoms and M is a solubilizing cation. The group $R^8$ may have a mixture of chain lengths. Preferably at least two-thirds of these groups have 6 to 12 carbon atoms. This will be the case when the moiety $R^8CH(—)CO_2(—)$ is derived from a coconut source, for instance. It is preferred that $R^9$ is a straight chain alkyl, notably methyl or ethyl.

Alkyl Benzene Sulfonates $$R^{10}ArSO_3M$$

where $R^{10}$ is an alkyl group of 8 to 18 carbon atoms, Ar is a benzene ring ($C_6H_4$) and M is a solubilizing cation. The group $R^{10}$ may be a mixture of chain lengths. Straight chains of 11 to 14 carbon atoms are preferred.

Paraffin sulfonates having 8 to 22 carbon atoms, preferably 12 to 16 carbon atoms, in the alkyl moiety. These surfactants are commercially available as Hostapur SAS from Hoechst Celanese.

Olefin sulfonates having 8 to 22 carbon atoms, preferably 12 to 16 carbon atoms. U.S. Patent No. 3,332,880 contains a description of suitable olefin sulfonates.

Organic phosphate based anionic surfactants include organic phosphate esters such as complex mono- or diester phosphates of hydroxyl-terminated alkoxide condensates, or salts thereof. Included in the organic phosphate esters are phosphate ester derivatives of polyoxyalkylated alkylaryl phosphate esters, of ethoxylated linear alcohols and ethoxylates of phenol. Also included are nonionic alkoxylates having a sodium alkylenecarboxylate moiety linked to a terminal hydroxyl group of the nonionic through an ether bond. Counterions to the salts of all the foregoing may be those of alkali metal, alkaline earth metal, ammonium, alkanolammonium and alkylammonium types.

Particularly preferred anionic surfactants are the fatty acid ester sulfonates with formula:

$$R^8CH(SO_3M)CO_2R^9$$

where the moiety $R^8CH(—)CO_2(—)$ is derived from a coconut source and $R^9$ is either methyl or ethyl; primary alkyl sulfates with the formula:

$$R^7OSO_3M$$

wherein $R^7$ is a primary alkyl group of 10 to 18 carbon atoms and M is a sodium cation; and paraffin sulfonates, preferably with 12 to 16 carbon atoms to the alkyl moiety.

Nonionic surfactants—Nonionic surfactants can be broadly defined as surface active compounds with one or more uncharged hydrophilic substituents. A major class of nonionic surfactants are those compounds produced by the condensation of alkylene oxide groups with an organic hydrophobic material which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative, but not limiting examples, of various suitable nonionic surfactant types are:

- polyoxyalkene condensates of aliphatic carboxylic acids, whether linear- or branched-chain and unsaturated or saturated, especially ethoxylated and/or propoxylated aliphatic acids containing from about 8 to about 18 carbon atoms in the aliphatic chain and incorporating from about 2 to about 50 ethylene oxide and/or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid,
- polyoxyalkene condensates of aliphatic alcohols, whether linear- or branched-chain and unsaturated or saturated, especially ethoxylated and/or propoxylated aliphatic alcohols containing from about 6 to about 24 carbon atoms and incorporating from about 2 to about 50 ethylene oxide and/or propylene oxide units. Suitable alcohols include "coconut" fatty alcohol, "tallow" fatty alcohol, lauryl alcohol, myristyl alcohol and oleyl alcohol.

Ethoxylated fatty alcohols may be used alone or in admixture with anionic surfactants, especially the preferred surfactants above. The average chain lengths of the alkyl group $R^{11}$ in the general formula:

$$R^{11}O(CH_2CH_2O)_nH$$

is from 6 to 20 carbon atoms. Notably the group $R^{11}$ may have chain lengths in a range from 9 to 18 carbon atoms.

The average value of n should be at least 2. The numbers of ethylene oxide residues may be a statistical distribution around the average value. However, as is known, the distribution can be affected by the manufacturing process or altered by fractionation after ethoxylation. Particularly preferred ethoxylated fatty alcohols have a group $R^{11}$ which has 9 to 18 carbon atoms while n is from 2 to 8.

Also included within this category are nonionic surfactants having a formula:

$$R^{12}\text{—}(CH_2\underset{\underset{R^{13}}{|}}{C}HO)_x(CH_2CH_2O)_y(CH_2\underset{\underset{R^{14}}{|}}{C}HO)_zH$$

linear alkyl wherein R is a linear alkyl hydrocarbon radical having an average of 6 to 18 carbon atoms, $R^{13}$ and $R^{14}$ are each linear alkyl hydrocarbons of about 1 to about 4 carbon atoms, x is an integer of from 1 to 6, y is an integer of from 4 to 20 and z is an integer from 4 to 25.

One preferred nonionic surfactant of the above formula is Poly-Tergent SLF-18 a registered trademark of the Olin Corporation, New Haven, Conn. having a composition of the above formula where $R^{12}$ is a $C_6$–$C_{10}$ linear alkyl mixture, $R^{13}$ and $R^{14}$ are methyl, x averages 3, y averages 12 and z averages 16. Another preferred nonionic surfactant is:

$$R^{15}\text{—}O\text{—}(CH_2\underset{\underset{CH_3}{|}}{C}HO)_j(CH_2CH_2O)_k(CH_2(OH)R^{16})$$

wherein $R^{15}$ is a linear, aliphatic hydrocarbon radical having from about 4 to about 18 carbon atoms including mixtures thereof; and $R^{16}$ is a linear, aliphatic hydrocarbon radical having from about 2 to about 26 carbon atoms including mixtures thereof; j is an integer having a value of from 1 to about 3; k is an integer having a value from 5 to about 30; and l is an integer having a value of from 1 to about 3. Most preferred are compositions in which j is 1, k is from about 10 to about 20 and l is 1. These surfactants are described in WO 94/22800. Other preferred nonionic surfactants are linear fatty alcohol alkoxylates with a capped terminal group, as described in U.S. 4,340,766 to BASF. Particularly preferred is Plurafac LF403 ex. BASF.

Another nonionic surfactant included within this category are compounds of formula:

$$R^{17}\text{—}(CH_2CH_2O)_qH$$

wherein $R^{17}$ is a $C_6$–$C_{24}$ linear or branched alkyl hydrocarbon radical and q is a number from 2 to 50; more preferably $R^{17}$ is a $C_8$–$C_{18}$ linear alkyl mixture and q is a number from 2 to 15.

polyoxyethylene or polyoxypropylene condensates of alkyl phenols, whether linear- or branched-chain and unsaturated or saturated, containing from about 6 to 12 carbon atoms and incorporating from about 2 to about 25 moles of ethylene oxide and/or propylene oxide.

polyoxyethylene derivatives of sorbitan mono-, di-, and tri-fatty acid esters wherein the fatty acid component has between 12 and 24 carbon atoms. The preferred polyoxyethylene derivatives are of sorbitan monolaurate, sorbitan trilaurate, sorbitan monopalmitate, sorbitan tripalmitate, sorbitan monostearate, sorbitan monoisostearate, sorbital tristearate, sorbitan monooleate, and sorbitan trioleate. The polyoxyethylene chains may contain between about 4 and 30 ethylene oxide units, preferably about 10 to 20. The sorbitan ester derivatives contain 1, 2 or 3 polyoxyethylene chains dependent upon whether they are mono-, di- or tri-acid esters.

polyoxyethylene-polyoxypropylene block copolymers having formula:

$$HO(CH_2CH_2O)_a(CH(CH_3)CH_2O)_b(CH_2CH_2O)_cH$$

or $$HO(CH(CH_3)CH_2O)_d(CH_2CH_2O)_e(CH(CH_3)CH_2O)_fH$$

wherein a, b, c, d, e and f are integers from 1 to 350 reflecting the respective polyethylene oxide and polypropylene oxide blocks of said polymer. The polyoxyethylene component of the block polymer constitutes at least about 10% of the block polymer. The material preferably has a molecular weight of between about 1,000 and 15,000, more preferably from about 1,500 to about 6,000. These materials are well-known in the art. They are available under the trademark "Pluronic" and "Pluronic R", a product of BASF Corporation.

Amine oxides having formula:

$$R^{18}R^{19}R^{20}N{=}O$$

wherein $R^{18}$, $R^{19}$ and $R^{20}$ are saturated aliphatic radicals or substituted saturated aliphatic radicals. Preferable amine oxides are those wherein $R^{18}$ is an alkyl chain of about 10 to about 20 carbon atoms and $R^{19}$ and $R^{20}$ are methyl or ethyl groups or both $R^{18}$ and $R^{19}$ are alkyl chains of about 6 to about 14 carbon atoms and $R^{20}$ is a methyl or ethyl group.

Amphoteric synthetic detergents—can be broadly described as derivatives of aliphatic tertiary amines, in which the aliphatic radical may be straight chain or branched and wherein one of the aliphatic substituents contain from about 8 to about 18 carbons and one contains an anionic water-solubilizing group, i.e., carboxy, sulpho, sulphato, phosphate or phosphono. Examples of compounds falling within this definition are sodium 3-dodecylamino propionate and sodium 2-dodecylamino propane sulfonate.

Zwitterionic synthetic detergents—can be broadly described as derivatives of aliphatic quaternary ammonium, phosphonium and sulphonium compounds in which the aliphatic radical may be straight chained or branched, and wherein one of the aliphatic substituents contains from about 8 to about 18 carbon atoms and one contains an anionic water-solubilizing group, e.g., carboxy, sulpho, sulphato, phosphato or phosphono. These compounds are frequently referred to as betaines. Besides alkyl betaines, alkyl amino and alkyl amido betaines are encompassed within this invention.

Alkyl Glycosides $$R^{21}O(R^{22}O)_n(Z^1)_p$$

wherein $R^{21}$ is a monovalent organic radical (e.g., a monovalent saturated aliphatic, unsaturated aliphatic or aromatic radical such as alkyl, hydroxyalkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to 18 and more preferably from about 9 to about 13) carbon atoms; $R^{22}$ is a divalent hydrocarbon radical containing from 2 to about 4 carbon atoms such as ethylene, propylene or butylene (most preferably the unit $(R^{22}O)_n$ represents repeating units of ethylene oxide, propylene oxide and/or random or block combinations thereof); n is a number having an average value of from 0 to about 12; $Z^1$ represents a moiety derived from a reducing saccharide containing 5 or 6 carbon atoms (most preferably a glucose unit); and p is a number having an average value of from 0.5 to about 10 preferably from about 0.5 to about 5 .

Examples of commercially available materials from Henkel Kommanditgesellschaft Aktien of Dusseldorf, Germany include APG 300, 325 and 350 with $R^{21}$ being $C_9$–$C_{11}$, n is 0 and p is 1.3, 1.6 and 1.8–2.2 respectively; APG 500 and 550 with $R^{21}$ is $C_{12}$–$C_{13}$, n is 0 and p is 1.3 and 1.8–2.2, respectively; and APG 600 with $R^{21}$ being $C_{12}$–$C_{14}$, n is 0 and p is 1.3.

While esters of glucose are contemplated especially, it is envisaged that corresponding materials based on other reducing sugars, such as galactose and mannose are also suitable.

Particularly preferred nonionic surfactants are polyoxyethylene and polyoxypropylene condensates of linear aliphatic alcohols.

The preferred range of surfactant is from about 0.5 to 30% by wt., more preferably from about 0.5 to 15% by weight of the composition.

Sequestrants

The detergent compositions herein may also optionally contain one or more transition metal chelating agents. These components may also have calcium and magnesium chelation capacity, but preferentially they show selectivity to binding heavy metal ions. Such chelating agents can be selected from the group consisting of amino carboxylates, amino phosphonates, polyfunctionally-substituted aromatic chelating agents and mixtures therein. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetraacetates, N-hydroxyethylethylenediaminetriacetates, nitrilotriacetates, ethylenediamine tetraproprionates, triethylenetetraaminehexaacetates, diethylenetriaminepentaacetates, ethylenediamine disuccinate, and ethanoldiglycines, alkali metal, ammonium, and substituted ammonium salts therein and mixtures therein.

Amino phosphonates are also suitable for use as chelating agents in the compositions of the invention when at least low levels of total phosphorus are permitted in detergent compositions, and include ethylenediaminetetrakis (methylenephosphonates) and diethylenetriaminepentakis (methylenephosphonates). Preferably, these amino phosphonates do not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

If utilized, these chelating agents will generally comprise from about 0.1% to about 10% by weight of the detergent compositions herein. More preferably, if utilized, the chelating agents will comprise from about 0.1% to about 5.0% by weight of such composition.

Anti-Scalants

Scale formation on dishes and machine parts can be a significant problem. It can arise from a number of sources but, primarily it results from precipitation of either alkaline earth metal carbonates, phosphates or silicates.

Calcium carbonate and phosphates are the most significant problem. To reduce this problem, ingredients to minimize scale formation can be incorporated into the composition. These include polyacrylates of molecular weight from 1,000 to 400,000 examples of which are supplied by Rohm & Haas, BASF and Alco Corp. and polymers based on acrylic acid combined with other moieties. These include acrylic acid combined with maleic acid, such as Sokalan CP5 and CP7 supplied by BASF or Acusol 479N supplied by Rohm & Haas; with methacrylic acid such as Colloid 226/35 supplied by Rhone-Poulenc; with phosphonate such as Casi 773 supplied by Buckman Laboratories; with maleic acid and vinyl acetate such as polymers supplied by Hüls; with acrylamide; with sulfophenol methallyl ether such as Aquatreat AR 540 supplied by Alco; with 2-acrylamido-2-methylpropane sulfonic acid such as Acumer 3100 supplied by Rohm & Haas or such as K-775 supplied by Goodrich; with 2-acrylamido-2-methylpropane sulfonic acid and sodium styrene sulfonate such as K-798 supplied by Goodrich; with methyl methacrylate, sodium methallyl sulfonate and sulfophenol methallyl ether such as Alcoperse 240 supplied by Alco; polymaleates such as Belclene 200 supplied by FMC; polymethacrylates such as Tamol 850 from Rohm & Haas; polyaspartates; ethylenediamine disuccinate; organo polyphosphonic acids and their salts such as the sodium salts of aminotri(methylenephosphonic acid) and ethane 1-hydroxy-1,1-diphosphonic acid. The anti-scalant, if present, is included in the composition from about 0.05% to about 10% by weight, preferably from 0.1% to about 5% by weight, most preferably from about 0.2% to about 5% by weight.

Corrosion inhibitors

The composition my optionally contain corrosion inhibitors to reduce the tarnishing of silver flatware. Such inhibitors include benzotriazole and other members of the azole family. Particularly preferred azoles, including imidazoles, are described in Angevaare ??-???-EDG, incorporated herein by reference. Additional antitarnish additives include water-soluble bismuth compounds such as bismuth nitrate as taught in GB 2,297,096 A; heavy metal salts of copper, iron, manganese, zinc, or titanium (EP 0 636 688 A1, GB 2,283,494 A); paraffin oil; and non-paraffin oil organic agents such as fatty esters of mono or polyhydridic alcohols as claimed in EP 0 690 122 A2.

Antifoams

The compositions of the present invention, when formulated for use in machine dishwashing compositions, preferably comprise an antifoam system. Suitable antifoam systems for use herein may comprise essentially any known antifoam compound, including, for example, silicone antifoams, silicone oil, mono- and distearyl acid phosphates, mineral oil, and 2-alkyl and alcanol antifoam compounds. Even if the machine dishwashing composition contains only defoaming surfactants, the antifoam assists to minimize foam which food soils can generate. The compositions may include 0.02 to 2% by weight of antifoam, preferably, 0.05 to 1.0%. Preferred antifoam systems are described in Angevaare et al.; U.S. Ser. No. 08/539,923, incorporated herein by reference.

Form of the Composition

The machine dishwashing compositions of the present invention can be formulated in any desirable form such as powders, granulates, pastes, liquids, gels, solids or tablets. As an example, the process of preparing a granulate may involve preparing a slurry of the ingredients identified above and drying the mixture by means of suitable equipment such as a turbine dryer (Turbogranulation dryer ex Vomm-Turbo Technology, Vomm Impianti E Processi SrL, Milan, Italy). Also, the process may involve preparing the slurry, spray-drying the slurry by conventional techniques using a spray tower in which the slurry is atomized and dried in a hot air stream, followed by restructuring the resulting powder, optionally after milling, in a granulation process (Lödige recycler and Lödige plow shear). In a particularly favorable process, the slurry is sprayed onto fine (recycled) particles and then dried to form gradually growing co-granules. Another attractive possibility is to dry the slurry in a rotary drum granulator and to spray slurry onto recirculated fines, thus building up coarser particles. These particles are either simultaneously or subsequently dried to give a co-granule with a more homogeneous moisture distribution than those obtained by use of a turbine dryer.

The process of preparing a tablet may involve admixing the ingredients identified above, transferring the mixture to the tablet die, and compressing with a compaction pressure from about of $3\times10^6$ kg/m$^2$ to about $3\times10^7$ kg/m$^2$. It may be preferable to pre-granulate some or all of the ingredients, optionally with surfactant to enhance dissolution, to give granulates of size 100–2000 microns and mix these together with any remaining material prior to compaction. Another possibility is to pre-coat the granulate with any liquid component of the composition via, for example, a fluid bed, pan coater or rolling drum to give encapsulates. The encapsulates are then compressed with a compaction pressure from about $1\times10^6$ kg/m$^2$ to about $3\times10^7$ kg/m$^2$.

Machine Dishwashing Method

A preferred machine dishwashing method comprises treating soiled articles selected from crockery, glassware, hollowware, silverware and cutlery and mixtures thereof, with an aqueous solution having dissolved or dispensed therein an effective amount of a machine dishwashing composition in accord with the invention. By an effective amount of the machine dishwashing composition it is meant from 8 g to 60 g of the composition dissolved or dispersed in a wash solution of volume from 3 to 10 liters, as typical product dosages and wash solution volumes commonly employed in conventional machine dishwashing methods.

The following examples will serve to distinguish this invention from the prior art and illustrate its embodiment more fully. Unless indicated otherwise, all parts, percentages and portions referred to are by weight.

EXAMPLES 1–2

Machine dishwashing detergent formulations were prepared as detailed below. All figures given refer to parts by weight. Example 1 is a granular product based on a phosphate builder while Example 2 is a liquid based on a non-phosphate builder.

| Component | Example 1 | Example 2 |
|---|---|---|
| Sodium tripolyphosphate | 50.0 | — |
| Tri-sodium citrate dihydrate | — | 30.0 |
| Glycerol | — | 6.0 |
| Borax | — | 3.0 |
| Cross-linked polycarboxylate[1] | — | 1.5 |
| Acrylate/maleate copolymer[2] | — | 5.0 |
| Amorphous sodium silicate ($SiO_2$:$Na_2O$ = 2) | 7.0 | — |
| Sodium carbonate | 10.0 | — |
| Sodium perborate monohydrate | 10.0 | — |
| Tetraacetyl ethylene diamine-83% | 2.0 | — |
| N-phthaloylamino-peroxycaproic acid[3] | — | 2.0 |
| Sodium sulfite | — | 0.3 |
| Sodium hydroxide (50%) | — | 0.8 |
| Nonionic[4] | 0.75 | 2.0 |
| Enzymes | 2.0 | 1.2 |
| Sodium sulfate | 13.25 | — |
| Cationic or amphoteric polymer[5] | 5.0 | 5.0 |
| Water | | to 100 |

[1]Carbopol 627 ex BF Goodrich
[2]Sokalan CP7 [40% solids] ex BASF
[3]Ex Ausimont
[4]LF 403 ex BASF
[5]Described in Example 3

EXAMPLE 3

The following cationic or amphoteric polymers were evaluated in the formulations of Examples 1–2 above.

| TRADE NAME | SUPPLIER | CHEMICAL DESCRIPTION |
|---|---|---|
| FlocAid 19 | Alco | 34% AA, 51% DMDAAC, 15% HPA, $1.4\times10^5$ MW |
| FlocAid 34 | Alco | 60% AA, 40% DMDAAC, $1.8\times10^5$ MW |
| EXP 2072 | Alco | 90% AA, 9% DMDAAC, 1% IAE |
| EXP 2075 | Alco | 90% AA, 9% DMDAAC, 1% IAE |
| 18,293-1 | Aldrich | 50% styrene, 50% maleic anhydride, $3\times10^5$ MW |
| 34,827-9 | Aldrich | DMDAAC monomer |
| 41,640-1 | Aldrich | copolymer of sodium maleate and olefin, $1\times10^4$ MW |
| 41,911-7 | Aldrich | copolymer of maleic anhydride and 1-octadecene |
| Salcare SC 10 | Allied Colloids | copolymer of DMDAAC and AM |
| Salcare SC 30 | Allied Colloids | DMDAAC |
| Salcare SC 60 | Allied Colloids | copolymer of AM and APTAC |
| Salcare SC 92 | Allied Colloids | copolymer of AM and ETMOPO (C) |
| Luviquat FC 370 | BASF | 30% MVI, 70% VP, $1\times10^5$ MW |
| Luviquat FC 550 | BASF | 50% MVI, 50% VP, $8\times10^4$ MW |
| Luviquat HM 552 | BASF | 50% MVI, 50% VP, $8\times10^5$ MW |
| Luviquat FC 905 | BASF | 96% MVI, 5% VP, $4\times10^4$ MW |
| Merquat 100 | Calgon Corp. | 100% DMDAAC, $4\times10^5$ MW |
| Merquat 280 | Calgon Corp. | 20% AA, 80% DMDAAC, $2\times10^5$ MW |
| Merquat 295 | Calgon Corp. | 5% AA, 95% DMDAAC, $5\times10^5$ MW |
| Merquat 550 | Calgon Corp. | 50% DMDAAC, 50% AM, $5\times10^6$ MW |
| Merquat 2200 | Calgon Corp. | 50% DMDAAC, 50% AM, $5\times10^6$ MW |
| Merquat Plus 3330 | Calgon Corp. | 25% AA, 50% DMDAAC, 25% AM, $4\times10^6$ MW |
| Merquat Plus 3331 | Calgon Corp. | 17% AA, 45% DMDAAC, 38% AM, $5\times10^6$ MW |
| Merquat S | Calgon Corp. | 50% DMDAAC, 50% AM, $7\times10^6$ MW |
| Sandolec CF | Clariant | cationic polyamido amine, see Eq. II |
| Sandolec CL | Clariant | quarternized poly imidazoline, see Eq. III |
| Sandolec CT | Clariant | DMIHPC |

-continued

| TRADE NAME | SUPPLIER | CHEMICAL DESCRIPTION |
|---|---|---|
| Sandolec WA | Clariant | cationic methylene guanidine |
| VRN | Clariant | DMIHPC |
| ABIL Quat 3270 | Goldschmidt | DQPDMS |
| Acrylidone 1001 | ISP | copolymer of AA and VP |
| Gafquat 734 | ISP | copolymer of VP and EEDMOPO(ES), $1 \times 10^5$ MW |
| Gafquat 755 | ISP | copolymer of VP and EEDMOPO(ES), $1 \times 10^5$ MW |
| Gafquat 755N | ISP | copolymer of VP and EEDMOPO(ES), $1 \times 10^6$ MW |
| Hsi | ISP | copolymer of VP and MAPTAC |
| Celquat H-100 | National Starch | copolymer of HEC and DMDAAC, high MW |
| Celquat L-200 | National Starch | copolymer of HEC and DMDAAC, moderate MW |
| 06090 | PolySciences | poly(ethyleneimine), $5 \times 10^4$ MW |
| 09657 | PolySciences | MAPTAC monomer |
| Mirapol A-15 | Rhone-Poulenc | Polyquarternium-2 |
| Polycare 133 | Rhone-Poulenc | MAPTAC |
| PC2 | Rohm & Haas | 90% AA and 10% APTAC, $6 \times 10^3$ MW |

KEY:
AA = acrylic acid
AM = acrylamide
APTAC = acrylamidopropyl trimethylammonium chloride
DMDAAC = dimethyldiallylammonium chloride
DMIHPC = dimethylimino 2-hydroxypropyl chloride
DQPDMS = diquaternary poly dimethylsiloxane
EEDMOPO (ES or C) = ethanaminium N,N,N ethyl dimethyl 2-[(2 methyl-1-oxo-2 propenyl) oxyl] ethyl sulfate or chloride salt
ETMOPO (ES or C) = ethanaminimum N,N,N trimethyl 2-[(2 methyl-1-l-oxo-2 propenyl) oxyl] sulfate or chloride salt
HEC = hydroxyethylcellulose
HPA = hydroxypropyl acrylate
IAE = itconic acid, alkyl ethoxylate ester
MAPTAC = methylacrylamidopropyl trimetylammonium chloride,
MVI = methyl vinyl imidazolium chloride,
VP = vinyl pyrrolidone

EXAMPLE 4

The effect on glass patterning corrosion of a machine dishwashing composition according to Example 1 of the present invention was determined by conducting a fifteen wash-cycle procedure in which the wash articles were evaluated for fading and loss in luster of colored decorations.

The fifteen wash-cycle procedure consisted of the following: A set of four 8 ounce household glasses; having brightly colored, overlaid glass patterns representing garden tools, seashells, fruit, and flowers; and a pair of 8 inch dinner plates having brightly colored, overlaid glass borders in red or yellow were placed within a Miele Super-Electronic G 595 SC machine dishwasher. The glasses were placed on the upper rack and the dinner plates were placed on the lower rack. The Universal 65° C. washing program was selected and the wash program executed using soft water (0° FH) and 40 grams of the machine dishwashing composition comprising Example 1. Each set of wash articles was put through fifteen consecutive cycles with the same formulation, after which time the articles were removed and graded for glass pattern corrosion effects. The grading was performed by two expert appraisers on each article and the results were averaged for the plates and glasses, respectively. Grading was through visual inspection according to the following six point scale:

0=no fading, identical to the unwashed article

1=very slight fading, noticeable only when referenced to the unwashed article

2=fading is noticeable, but colors are still bright and lustrous

3=moderate fading, reduced color intensity level

4=strong fading, pale, washed-out colors

5=severe fading, color essentially completely removed

| TRADE NAME | AVG. FADING SCORE ON PLATES | AVG. FADING SCORE ON GLASSES |
|---|---|---|
| CONTROL (no polymer) | 2.25 | 2.75 |
| FlocAcid 19 | 1 | 1.5 |
| FlocAcid 34 | 1 | 1 |
| EXP 2072 | 2.25 | 3.5 |
| EXP 2075 | 2.5 | 2.25 |
| 18,293-1 | 3 | 3.5 |
| 34,827-9 | 1.5 | 2.5 |
| 41,640-1 | 3 | 2 |
| 41,911-7 | 3 | 3.5 |
| Salcare SC 10 | 0.75 | 1 |
| Salcare SC 30 | 1 | 1 |
| Salcare SC 60 | 1 | 1.75 |
| Salcare SC 92 | 1.5 | 1.75 |
| Luviquat FC 370 | 0.75 | 1.75 |
| Luviquat FC 560 | 1.5 | 2 |
| Luviquat HM 552 | 0.5 | 1.5 |
| Luviquat FC 905 | 1.25 | 2 |
| Merquat 100 | 1 | 0.5 |
| Merquat 280 | 0.5 | 0.5 |
| Merquat 295 | 1 | 0.5 |
| Merquat 550 | 0.5 | 0.5 |
| Merquat 2200 | 0.5 | 0.5 |
| Merquat Plus 3330 | 1 | 1 |
| Merquat Plus 3331 | 0.5 | 0.5 |
| Merquat S | 0.5 | 0.5 |
| Sandolec CF | 0.5 | 0.75 |
| Sandolec CL | 0.5 | 0.5 |
| Sandolec CT | 0.75 | 0.5 |
| Sandolec WA | 0.5 | 0.5 |
| VRN | 0.5 | 0.5 |
| ABIL Quat 3270 | 0.5 | 0.5 |
| Acrylidone 1001 | 1 | 1.5 |
| Gafquat 734 | 0.75 | 0.75 |
| Gafquat 755 | 1 | 0.75 |
| Gafquat 755N | 1 | 1.75 |
| Hsi | 1 | 0.75 |
| Celquat H-100 | 1 | 1.25 |
| Celquat L-200 | 1 | 1.5 |
| 06090 | 0.5 | 0.5 |
| 09657 | 2.0 | 3.25 |
| Mirapol A-15 | 0.5 | 0.5 |
| Polycare 133 | 2 | 0.75 |
| PC2 | 0.5 | 2.0 |

As shown by the above example, water soluble copolymers which contain cationic monomer groups significantly reduce the fading of overlaid patterns on plates and glasses relative to the control. Similarly, water soluble copolymers which contain amphoteric monomer groups, such as Acrylidone 1001, also significantly reduce the fading of overlaid patterns. However, water soluble copolymers which do not contain such monomer groups, such as 18,293-1, 41,640-1, and 41,911-7 offer no improvement relative to the control and in some cases even enhance fading. Likewise, water soluble copolymers containing an insufficient level of the cationic monomer groups do not deliver the optimum level of fading protection. As an example, EXP 2072 and EXP 2075 each contain 9% by weight of the cationic monomer DMDAAC and do not deliver the same protection as do copolymers with higher DMDAAC levels such as FlocAid 19, FlocAid 34, Merquat 280, or Merquat 295.

This example demonstrates that the weight fraction of the cationic or amphoteric polymers of the invention which is composed of the above-described cationic or amphoteric monomer units can range from 1 to 100%, but is preferably in the range 10 to 100%, and is most preferably in the range from 15 to 80% of the entire polymer. In addition, the cationic monomer groups themselves, such as 34,827-9 and 09657, do not offer the same degree of protection toward patterned glassware as that due to the corresponding polymers. Thus the protection observed for the cationic or amphoteric polymers is imparted by the polymers themselves and not by any unpolymerized, residual monomer.

EXAMPLE 5

The procedure of Example 4 was repeated with the exception that 26 grams of the machine dishwashing composition comprising Example 2 was substituted for 40 grams of that of Example 1. In addition, preweighed lead glass tiles of 5 cm×5 cm dimension were added to the upper rack of the Miele Super-Electronic G 595 SC machine dishwasher. The Universal 65° C. washing program was selected and the glasses, plates, and lead glass tiles were put through fifteen consecutive cycles with the formulation, after which time the glasses and plates were graded as before and the weight changes of the lead glass tiles were determined as a measure of the corrosive tendency of the trial formulation towards the colored glass comprising the patterning. Also, the tile was judged for intensity and coverage of discoloration in reflected light. Scores of 0 to 5 were assigned by two expert appraisers and then averaged. On this six point scale, 0 indicates that the entire tile surface was free from discoloration and 5 indicates that the entire tile surface was very strongly discolored blue in reflected light. Results in the presence and absence of a cationic polymer of the current invention were as follows:

| TRADE NAME | AVG. FADING SCORE ON PLATES | AVG. FADING SCORE ON GLASSES | AVG. WEIGHT LOSS FROM LEAD GLASS PLATE (%) | DISCOLORATION SCORE ON LEAD GLASS PLATE |
|---|---|---|---|---|
| Control | 2.0 | 2.25 | 0.035 | 5 |
| FlocAcid 19 | 1.0 | 1.5 | 0.02 | 2 |

This example demonstrates that a water soluble copolymer containing cationic monomer groups significantly reduces fading of overlaid patterns on plates and glasses in a nonphosphate built dishwashing detergent. In addition, weight loss and discoloration of lead glass tiles, measures of the corrosive tendency of the detergent towards the colored glass comprising the patterning, is also significantly reduced.

We claim:

1. A detergent composition which reduces corrosion of dishware in an automatic dishwashing machine comprising:

a) a glassware protective amount of a water-soluble cationic polymer having at least 1 monomer unit having a cationic charge over a portion of the pH range 6–11, wherein the cationic polymer is a compound of formula I:

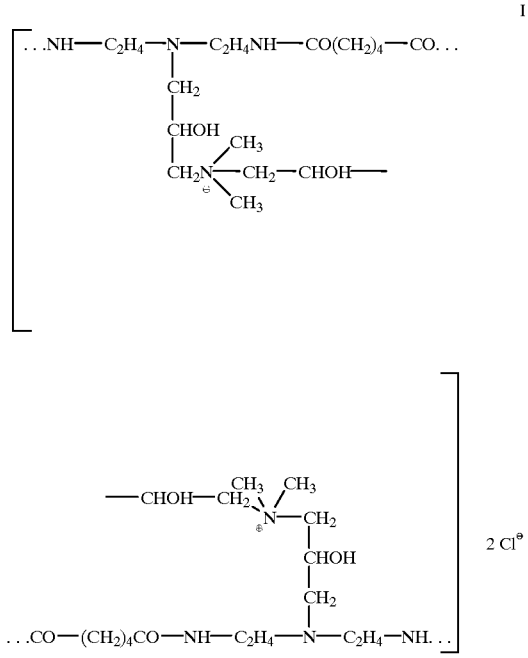

I and b) 1 to 90 wt. % of a builder selected from the group consisting of a phosphate builder, a non-phosphate builder and mixtures thereof.

2. A detergent composition which reduces corrosion of dishware in an automatic dishwashing machine comprising:

a) a glassware protective amount of a water-soluble cationic polymer, having at least 1 monomer unit having a cationic charge over a portion of the pH range 6–11, wherein the cationic polymer is a compound having the formula III:

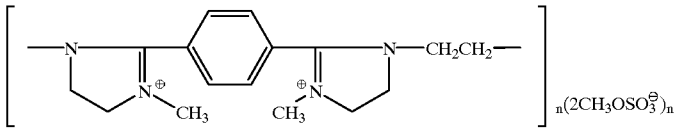

III and b) 1 to 90 wt. % of a builder selected from the group consisting of a phosphate builder, a non-phosphate builder and mixtures thereof.

3. A composition according to claim 1 wherein the polymer is present at a level of 0.1 to 20 wt. % of the total composition.

4. A composition according to claim 1 wherein the phosphate builder is selected from the group consisting of alkali metal tripolyphosphates, sodium, potasssium and ammonium pyrophosphate, sodium and potassium orthophosphate, sodium polymeta/phosphate in which the degree of polymerization ranges from about 6 to 21, and salts of phytic acid.

5. A composition according to claim 1 wherein the nonphosphate builder is selected from the group consisting of water soluble alkali metal carbonates, bicarbonates, sesquicarbonates, borates, silicates, layered silicates, metasilicates, crystalline and amorphous aluminosilicates, alkali metal citrates, nitrilotriacetates, oxydisuccinates, acrylate/maleate copolymers and acrylate/maleate/vinyl alcohol terpolymers.

6. A composition according to claim 1 wherein the composition further comprises an effective amount of an oxygen bleach source.

7. A method for reducing fading or corrosion of dishware in an automatic dishwashing machine comprising the steps of:

a) applying a glassware protective amount of a composition comprising:

(i) a glassware protective amount of a water soluble cationic polymer having at least 1 monomer unit having a cationic charge over a portion of the pH range 6–11, wherein the cationic polymer is a compound of formula I:

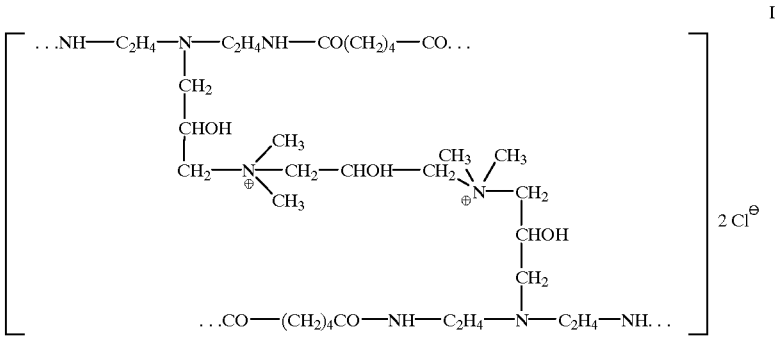

I (ii) a phosphate or nonphosphate builder present in an amount of from 1 to 90 wt. %; and b) substantially cleaning the dishware without substantially fading or corroding.

8. A method for reducing fading or corrosion of dishware in an automatic dishwashing machine comprising the steps of:

a) applying a glassware protective amount of a composition comprising:

(i) a glassware protective amount of a water soluble cationic or amphoteric polymer having at least 1 monomer unit having a cationic change over a portion of the pH ranges 6–11, wherein the cationic polymer is a compound having the formula III:

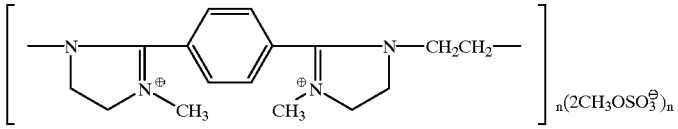

III (ii) a phosphate or nonphosphate builder present in an amount of from 1 to 90 wt. %; and b) substantially cleaning the dishware without substantially fading or corroding.

9. A method according to claim 7 wherein the polymer is present at a level of 0.1 to 20 wt. % of the total composition.

10. A method according to claim 7 wherein the phosphate builder is selected from the group consisting of alkali metal tripolyphosphates, sodium, potasssium and ammonium pyrophosphate, sodium and potassium orthophosphate, sodium polymeta/phosphate in which the degree of polymerization ranges from about 6 to 21, and salts of phytic acid.

11. A method according to claim 7 wherein the nonphosphate builder is selected from the group consisting of water soluble alkali metal carbonates, bicarbonates, sesquicarbonates, borates, silicates, layered silicate, metasilicates, crystalline and amorphous aluminosilicates, alkali metal citrates, nitrilotriacetates, oxydisuccinates, acrylate/maleate copolymers and acrylate/maleate/vinyl alcohol terpolymers.

12. A method according to claim 7 wherein the composition further comprises a bleach an effective amount of an oxygen bleach source.

* * * * *